US006682314B2

(12) United States Patent
Umemura et al.

(10) Patent No.: US 6,682,314 B2
(45) Date of Patent: Jan. 27, 2004

(54) CONTROL VALVE FOR VARIABLE DISPLACEMENT TYPE COMPRESSOR

(75) Inventors: Satoshi Umemura, Kariya (JP); Tatsuya Hirose, Kariya (JP); Taku Adaniya, Kariya (JP); Ken Suitou, Kariya (JP); Ryo Matsubara, Kariya (JP); Kazuhiko Minami, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/054,341

(22) Filed: Jan. 22, 2002

(65) Prior Publication Data

US 2002/0098091 A1 Jul. 25, 2002

(30) Foreign Application Priority Data

Jan. 23, 2001 (JP) ..... 2001-014615

(51) Int. Cl.[7] ..... F04B 1/26

(52) U.S. Cl. ..... 417/222.2; 251/61.5; 62/228.5

(58) Field of Search ..... 417/222.2, 53, 417/269, 222.1; 251/61.5, 129.02, 129.07, 129.08, 129.15; 62/228.1, 228.5

(56) References Cited

U.S. PATENT DOCUMENTS 6,010,312 A 1/2000 Suitou et al. ..... 417/222.2
6,146,106 A * 11/2000 Suitou et al. ..... 417/222.2
6,179,572 B1 * 1/2001 Taguchi ..... 417/222.2
6,217,291 B1 * 4/2001 Ota et al. ..... 417/222.2
6,234,763 B1 5/2001 Ota et al. ..... 417/222.2
6,361,283 B1 * 3/2002 Ota et al. ..... 417/222.2
6,398,516 B1 * 6/2002 Kawaguchi et al. ..... 417/22.2

FOREIGN PATENT DOCUMENTS

EP 0 953 766 A2 * 11/1999
JP 2001-12347 * 1/2001

* cited by examiner

*Primary Examiner*—Cheryl J. Tyler
*Assistant Examiner*—Han L Liu
(74) *Attorney, Agent, or Firm*—Morgan & Finnegan, LLP

(57) ABSTRACT

A control valve has a valve housing and a valve chamber defined in the valve housing. A valve body is accommodated in the valve chamber for adjusting the opening degree of a supply passage. A pressure sensing chamber is defined in the valve housing. The pressure at a pressure monitoring point in a refrigerant circuit is applied to the pressure sensing chamber. A bellows is located in the pressure sensing chamber. The bellows has a movable end. A transmission rod is slidably supported by the valve housing. The transmission rod includes the valve body. A support spring is located between the inner wall of the pressure sensing chamber and the movable end of the bellows. The spring supports the movable end such that the movable end can be displaced. The movable end of the bellows includes a protrusion such that the spring and the movable end of the bellows are fitted to each other.

21 Claims, 5 Drawing Sheets

CONTROL VALVE FOR VARIABLE DISPLACEMENT TYPE COMPRESSOR

BACKGROUND OF THE INVENTION

The present invention relates to a control valve for a variable displacement compressor that is used in a refrigerant circuit of a vehicle air conditioner and changes the displacement in accordance with the pressure in a crank chamber.

The control valve includes, for example, a valve body, a bellows, and a transmission rod. The opening degree of the valve body is controlled in accordance with the pressure in a crank chamber. The movable end of the bellows is displaced in accordance with the pressure in a suction pressure zone of the refrigerant circuit. The transmission rod couples the valve body to the movable end of the bellows so that the valve body integrally moves with the movable end of the bellows. When the movable end of the bellows is displaced in accordance with the pressure in the suction pressure zone, the valve body moves by means of the transmission rod. The discharge displacement of the compressor is adjusted to cancel the variations of the pressure in the suction pressure zone in accordance with the position of the valve body.

If the movable end of the bellows simply contacts the transmission rod, a measurement error in the bellows during manufacturing may incline the axis of the bellows with respect to the axis of the valve housing. If the inclination of the bellows is great, the bellows contacts the inner wall of a sensing chamber, in which the bellows is accommodated. As a result, the fluctuations of pressure in the suction pressure zone are not reliably communicated to the valve body. That is, the control valve malfunctions.

To reduce the malfunction of the control valve, the following art has been proposed. That is, a recess is formed on the movable end of the bellows. The end of the transmission rod is fitted to the recess. The bellows is supported by a valve housing through the transmission rod. Therefore, the inclination of the bellows caused by a measurement error is corrected. However, due to the correction of the inclination, the elastic bellows generates stress in a direction that intersects the axis of the valve housing. The stress is applied to the transmission rod through the fitted portion. Therefore, the friction between the transmission rod and the valve housing increases due to the stress. As a result, the hysteresis in the operational characteristics of the control valve increases.

SUMMARY OF THE INVENTION

The objective of the present invention is to provide a control valve for a variable displacement compressor that suppresses the inclination of a bellows and prevents the transmission rod from being affected by forces applied by the bellows in a direction that intersects the axial direction.

To achieve the foregoing objective, the present invention provides a control valve used for a variable displacement compressor installed in a refrigerant circuit. The compressor varies the displacement in accordance with the pressure in a crank chamber. The compressor has a control passage, which connects the crank chamber to a pressure zone in which the pressure is different from the pressure of the crank chamber. The control valve includes a valve housing, a valve chamber, a valve body, a pressure sensing chamber, a bellows, a transmission rod, and an elastic member. The valve chamber is defined in the valve housing. The valve body is accommodated in the valve chamber for adjusting the opening degree of the control passage. The pressure sensing chamber is defined in the valve housing. The pressure at a pressure monitoring point in the refrigerant circuit is applied to the pressure sensing chamber. The bellows is located in the pressure sensing chamber. The bellows has a movable end. The transmission rod is slidably supported by the valve housing between the valve chamber and the pressure sensing chamber. The transmission rod moves the valve body in accordance with the displacement of the bellows. The bellows is displaced in accordance with the variations of the pressure in the pressure sensing chamber thereby moving the valve body such that the displacement of the compressor is adjusted to cancel the variations of the pressure in the pressure sensing chamber. The movable end of the bellows and the transmission rod contact each other and can be relatively displaced in a direction intersecting the axis of the valve housing. The elastic member is located between the inner wall of the pressure sensing chamber and the movable end of the bellows. The elastic member elastically supports the movable end such that the movable end can be displaced. One of the elastic member and the movable end of the bellows includes a recess and the other one includes a protrusion such that the elastic member and the movable end of the bellows are fitted to each other.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control valve CV according to a first embodiment of the present invention will now be described with reference to FIGS. 1 and 2. The control valve CV is used in a variable displacement swash plate type compressor located in a vehicle air conditioner.

Figure 1:
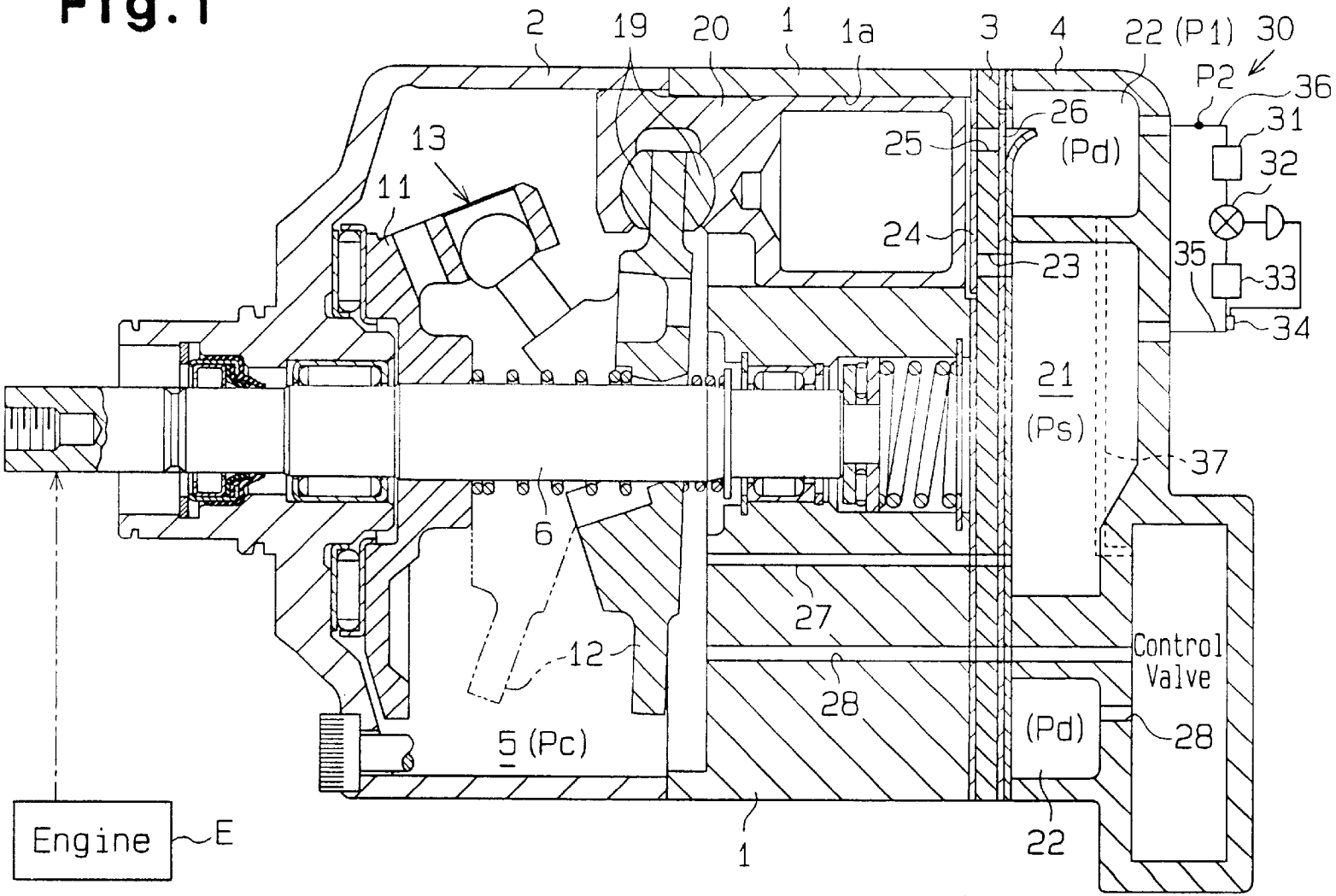
FIG. 1 is a cross-sectional view illustrating a swash plate type variable displacement compressor according to a first embodiment of the present invention.

As shown in FIG. 1, the compressor includes a cylinder block 1, a front housing member 2 connected to the front end of the cylinder block 1, and a rear housing member 4 connected to the rear end of the cylinder block 1. A valve plate assembly 3 is located between the rear housing member 4 and the cylinder block 1. The cylinder block 1, the front housing member 2, and the rear housing member 4 form the housing of the compressor.

A crank chamber 5, in this embodiment, is defined between the cylinder block 1 and the front housing member 2. A drive shaft 6 extends through the crank chamber 5 and is rotatably supported. The drive shaft 6 is connected to and driven by an external drive source, which is an engine E in this embodiment.

A lug plate 11 is fixed to the drive shaft 6 in the crank chamber 5 to rotate integrally with the drive shaft 6. A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The hinge mechanism 13 and the lug plate 11 cause the swash plate 12 to move integrally with the drive shaft 6.

Cylinder bores 1*a* (only one is shown in FIG. 1) are formed in the cylinder block 1 at constant angular intervals around the axis L of the drive shaft 6. Each cylinder bore 1*a* accommodates a single headed piston 20 such that the piston 20 can reciprocate in the cylinder bore 1*a*. The opening of each cylinder bore 1*a* is closed by the valve plate assembly 3 and the corresponding piston 20. A compression chamber, the volume of which varies in accordance with the reciprocation of the piston 20, is defined in each cylinder bore 1*a*. The front end of each piston 20 is coupled to the periphery of the swash plate 12 through a pair of shoes 19. The swash plate 12 is rotated as the drive shaft 6 rotates. Rotation of the swash plate 12 is converted into reciprocation of each piston 20 by the corresponding pair of shoes 19.

A suction chamber 21 and a discharge chamber 22 are defined between the valve plate assembly 3 and the rear housing member 4. The discharge chamber 22 is located about the suction chamber 21. The valve plate assembly 3 has suction ports 23, suction valve flaps 24, discharge ports 25, and discharge valve flaps 26. Each set of the suction port 23, the suction valve flap 24, the discharge port 25, and the discharge valve flap 26 corresponds to one of the cylinder bores 1*a*.

When each piston 20 moves from the top dead center position to the bottom dead center position, refrigerant gas in the suction chamber 21 flows into the corresponding cylinder bore 1*a* via the corresponding suction port 23 and suction valve flap 24. When each piston 20 moves from the bottom dead center position to the top dead center position, refrigerant gas in the corresponding cylinder bore 1*a* is compressed to a predetermined pressure and is discharged to the discharge chamber 22 via the corresponding discharge port 25 and discharge valve flap 26.

A mechanism for controlling the pressure in the crank chamber 5, or crank chamber pressure Pc, includes a bleed passage 27, a supply passage 28, and the control valve CV. The passages 27, 28 are formed in the housing. The bleed passage 27 connects a zone that is exposed to a suction pressure Ps (suction pressure zone), or the suction chamber 21, with the crank chamber 5. The supply passage 28 connects a zone that is exposed to a discharge pressure Pd (discharge pressure zone), or the discharge chamber 22, with the crank chamber 5. The control valve CV is located in the supply passage 28.

The control valve CV adjusts the opening of the supply passage 28 to adjust the flow rate of refrigerant gas from the discharge chamber 22 to the crank chamber 5. The crank chamber pressure Pc is changed in accordance with the relationship between the flow rate of refrigerant gas flowing from the discharge chamber 22 to the crank chamber 5 and the flow rate of refrigerant gas flowing out from the crank chamber 5 to the suction chamber 21 through the bleed passage 27. The difference between the crank chamber pressure Pc and the pressure in the cylinder bores 1*a* through the piston 20 is changed in accordance with the crank chamber pressure Pc, which varies the inclination angle of the swash plate 12. This alters the stroke of each piston 20 and the compressor displacement.

The refrigerant circuit of the vehicular air-conditioner is made up of the compressor and an external refrigerant circuit 30. The external refrigerant circuit 30 connects the discharge chamber 22 to the suction chamber 21, and includes a condenser 31, an expansion valve 32, and an evaporator 33. A downstream pipe 35 is located in a downstream portion of the external refrigerant circuit 30. The downstream pipe 35 connects the outlet of the evaporator 33 with the suction chamber 21 of the compressor. An upstream pipe 36 is located in the upstream portion of the external refrigerant circuit 30. The upstream pipe 36 connects the discharge chamber 22 of the compressor with the inlet of the condenser 31.

The greater the flow rate of the refrigerant flowing in the refrigerant circuit is, the greater the pressure loss per unit length of the circuit or piping is. That is, the pressure loss (pressure difference) between pressure monitoring points P1, P2 has a positive correlation with the flow rate of the refrigerant in the circuit. Detecting the pressure difference between the pressure monitoring points P1, P2 permits the flow rate of refrigerant in the refrigerant circuit to be indirectly detected. Hereinafter, the pressure difference between the pressure monitoring points P1, P2 will be referred to as pressure difference ΔPd.

Figures 2, 2A:
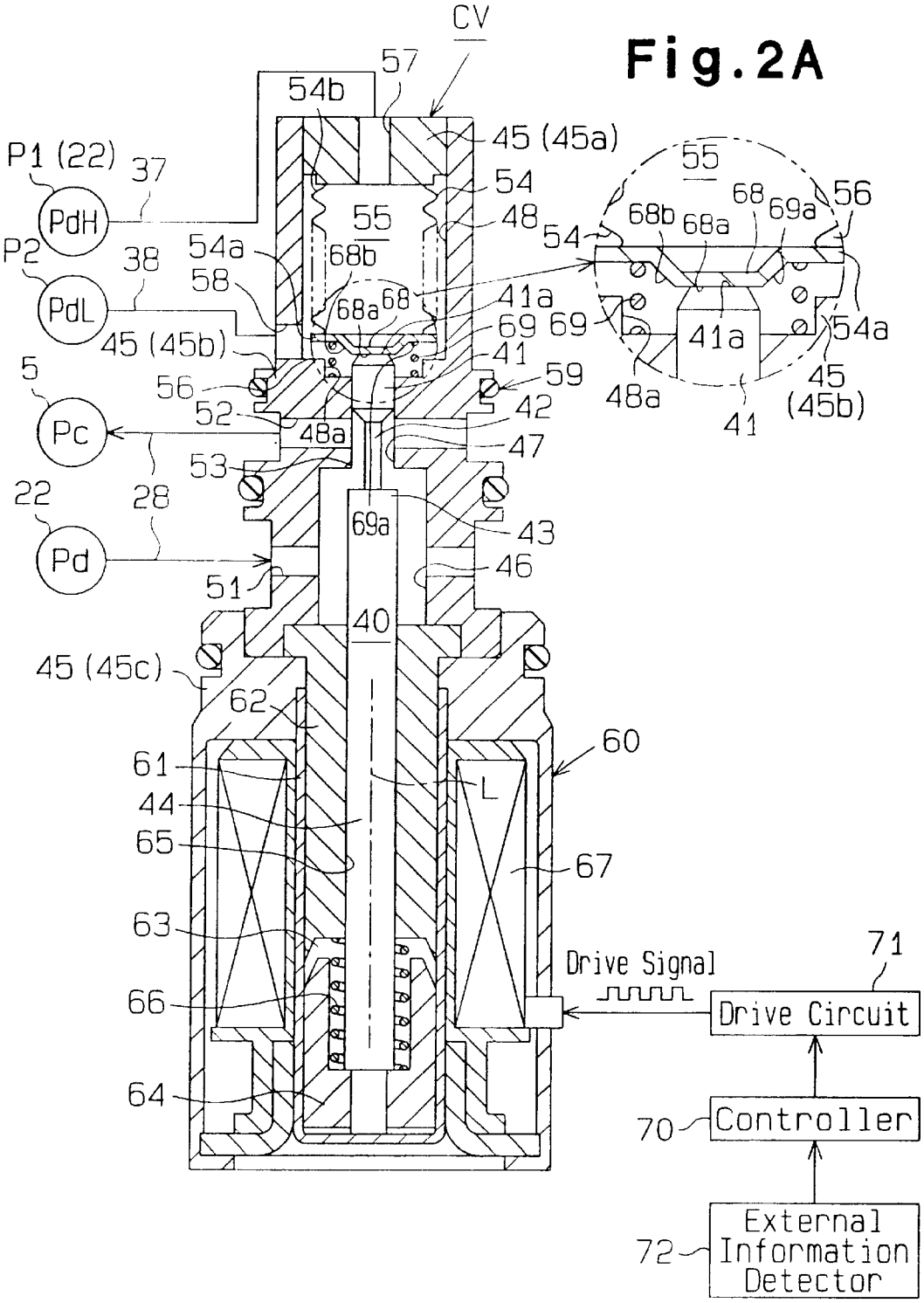
FIG. 2 is a cross-sectional view illustrating the control valve provided in the compressor shown in FIG. 1.
FIG. 2A is an enlarged partial cross-sectional view illustrating the vicinity of the movable end of the bellows shown in FIG. 2.

As shown in FIG. 2, the first pressure monitoring point P1 is located in the discharge chamber 22, the pressure of which is equal to that of the most upstream section of the upstream pipe 36. The second pressure monitoring point P2 is set midway along the upstream pipe 36 at a position separated from the first pressure monitoring point P1 by a predetermined distance. The pressure PdH at the first pressure monitoring point P1 is applied to the displacement control valve CV through a first pressure introduction passage 37. The pressure PdL at the second pressure monitoring point P2 is applied to the displacement control valve CV through a second pressure introduction passage 38.

The control valve CV has a supply control valve portion 59 and a solenoid 60. The supply control valve portion 59 controls the opening (throttle amount) of the supply passage 28, which connects the discharge chamber 22 with the crank chamber 5. The solenoid 60 serves as an electromagnetic actuator for controlling a transmission rod 40 located in the control valve CV on the basis of an externally supplied electric current. Specifically, the solenoid 60 applies force to a bellows 54, which will be described later, through the transmission rod 40 on the basis of an externally supplied electric current. The transmission rod 40 includes a distal end portion 41, a coupler 42, a valve body portion 43, and a guide portion 44. The valve body portion 43 is located at the substantial center of the transmission rod 40 and is a part of the guide portion 44.

A valve housing 45 of the control valve CV has a plug 45*a*, an upper half body 45*b*, and a lower half body 45*c*. A valve chamber 46 and a communication passage 47 are defined in the upper half body 45*b*. A pressure sensing chamber 48 is defined between the upper half body 45*b* and the plug 45*a*.

The transmission rod 40 moves in the axial direction L of the valve housing 45 in the valve chamber 46 and the communication passage 47. The valve chamber 46 is selectively connected to and disconnected from the communication passage 47 in accordance with the axial position of the transmission rod 40. The communication passage 47 is isolated from the pressure sensing chamber 48 by the distal end portion 41 of the transmission rod 40, which is fitted to the communication passage 47.

The upper end face of a stationary iron core 62, which will be discussed below, serves as the bottom wall of the valve chamber 46. A first valve port 51, extending radially from the valve chamber 46, connects the valve chamber 46 with the discharge chamber 22 through an upstream part of the supply passage 28. A second valve port 52, extending radially from the communication passage 47, connects the communication passage 47 with the crank chamber 5 through a downstream part of the supply passage 28. Thus, the first valve port 51, the valve chamber 46, the communication passage 47, and the second valve port 52 serve as part of the control passage, or the supply passage 28, which connects the discharge chamber 22 with the crank chamber 5.

The valve body portion 43 of the transmission rod 40 is located in the valve chamber 46. The step between the valve chamber 46 and the communication passage 47 functions as a valve seat 53. When the transmission rod 40 moves from the position of FIG. 2 (the lowest position) to the highest position, at which the valve body portion 43 contacts the valve seat 53, the communication passage 47 is isolated. That is, the valve body portion 43 functions as a valve body that selectively opens and closes the supply passage 28.

A bottomed cylindrical bellows 54 is located in the pressure sensing chamber 48. The bellows 54 is formed of metal material. The bellows 54 is preferably made of alloy mainly made of copper. A fixed end 54*b* at the upper end of the bellows 54 is fixed to the plug 45*a* of the valve housing 45 by, for example, welding. The pressure sensing chamber 48 is divided into a first pressure chamber 55 and a second pressure chamber 56 by the bellows 54.

As shown in FIG. 2A, a protrusion 68 is formed on a movable end 54*a*, which is the lower end of the bellows 54, and faces the transmission rod 40. The bellows 54 is installed in a compressed state. Therefore, a lower end surface 68*a* of the protrusion 68 is pressed against an upper end surface 41*a* of the distal end portion 41 by the downward force generated by the compression of the bellows 54. The movable end 54*a*, or the bellows 54, and the distal end portion 41, or the transmission rod 40, are relatively displaced in a direction intersecting the axis L of the valve housing 45.

An elastic member, which is a support spring 69 formed of a coil spring in the first embodiment, is arranged between the inner bottom surface of the pressure sensing chamber 48 and the movable end 54*a* of the bellows 54. The proximal end of the support spring 69 is fitted to a spring seat 48*a*, which is formed on the inner bottom surface of the pressure sensing chamber 48. The distal end of the support spring 69 is fitted to the movable end 54*a* through a circumferential surface 68*b* of the protrusion 68. The center space in the support spring 69 serves as a recess 69*a*, in which the protrusion 68 of the movable end 54*a* is fitted. As mentioned above, the movable end 54*a* of the bellows 54 is elastically supported by the valve housing 45 through the support spring 69 and the spring seat 48*a* to be displaced in the direction of axis L.

The first pressure chamber 55 is connected to the first pressure monitoring point P1, which is the discharge chamber 22, through a P1 port 57 formed in the plug 45*a*, and the first pressure introduction passage 37. The second pressure chamber 56 is connected to the second pressure monitoring point P2 through a P2 port 58, which is formed in the upper half body 45*b* of the valve housing 45, and the second pressure introduction passage 38. Therefore, the first pressure chamber 55 is exposed to the pressure PdH monitored at the first pressure monitoring point P1, and the second pressure chamber 56 is exposed to the pressure PdL monitored at the second pressure monitoring point P2.

The solenoid 60 includes an accommodating cup 61. The stationary iron core 62 is fitted in the upper part of the accommodating cup 61. A solenoid chamber 63 is defined in the accommodating cup 61. A movable iron core 64 is accommodated in the solenoid chamber 63 to move along the axis of the valve housing 45. An axially extending guide hole 65 is formed in the central portion of the stationary iron core 62. The guide portion 44 of the transmission rod 40 is located to move axially in the guide hole 65. The lower end of the guide portion 44 is fixed to the movable iron core 64 in the solenoid chamber 63. Accordingly, the movable iron core 64 moves vertically and integrally with the transmission rod 40.

In the solenoid chamber 63, a coil spring 66 is located between the stationary iron core 62 and the movable iron core 64. The spring 66 urges the movable iron core 64 away from the stationary iron core 62 and urges the transmission rod 40, or the valve body portion 43, downward as viewed in the drawing.

A coil 67 is wound about the stationary iron core 62 and the movable iron core 64. The coil 67 is connected to a drive circuit 71, and the drive circuit 71 is connected to a controller 70. The controller 70 is connected to an external information detector 72. The controller 70 receives external information (on-off state of the air conditioner, the temperature of the passenger compartment, and a target temperature) from the detector 72. Based on the received information, the controller 70 commands the drive circuit 71 to supply a drive signal to the coil 67. The coil 67 generates an electromagnetic force, the magnitude of which depends on the value of the supplied current, between the stationary iron core 62 and the movable iron core 64. The value of the current supplied to the coil 67 is controlled by controlling the voltage applied to the coil 67. In this embodiment, the voltage applied to the coil 67 is duty controlled.

The opening degree of the control valve CV is determined by the position of the transmission rod 40.

As shown in FIG. 2, when no current is supplied to the coil 67 (duty ratio=0%), the downward force of the bellows 54 and the spring 66 is dominant in determining the position of the transmission rod 40. As a result, the transmission rod 40 is moved to its lowermost position shown in FIG. 2 and causes the valve body portion 43 to fully open the communication passage 47. Accordingly, the crank chamber pressure Pc is maximized. Therefore, the difference between the crank chamber pressure Pc and the pressure in the cylinder bores la through the piston 20 is increased, which minimizes the inclination angle of the swash plate 12 and the compressor displacement.

When the electric current corresponding to the minimum duty ratio (duty ratio>0%) within the range of duty ratios is supplied to the coil 67, the upward electromagnetic force exceeds the downward force of the bellows 54 and the spring 66, and the transmission rod 40 moves upward. In this state, the resultant of the upward electromagnetic force and the downward force of the spring 66 acts against the resultant of the forces of the bellows 54 and the force based on the pressure difference between the pressure monitoring points P1, P2 (ΔPd=PdH−PdL) and the upward force of support spring 69. The position of the valve body portion 43 of the transmission rod 40 relative to the valve seat 53 is determined such that upward and downward forces are balanced.

When the speed of the engine E is lowered, the flow rate of refrigerant in the refrigerant circuit is decreased. At this time, the downward force based on the pressure difference ΔPd is decreased and the transmission rod 40 (the valve body portion 43) moves upward, which decreases the opening of the communication passage 47. Accordingly, the crank chamber pressure Pc is decreased, and the difference between the crank chamber pressure Pc and the pressure in each cylinder bore 1*a* decreases. Thus, the inclination angle of the swash plate 12 increases, which increases the discharge displacement of the compressor. When the discharge displacement of the compressor increases, the flow rate of refrigerant in the refrigerant circuit increases, which increases the pressure difference ΔPd.

When the speed of the engine E is increased, the flow rate of refrigerant in the refrigerant circuit is increased. At this time, the downward force based on the pressure difference ΔPd is increased and the transmission rod 40 (the valve body portion 43) moves downward, which increases the opening of the communication passage 47. Accordingly, the crank chamber pressure Pc is increased and the difference between the crank chamber pressure Pc and the pressure in each cylinder bore 1*a* increases. Thus, the inclination angle of the swash plate 12 decreases, which decreases the discharge displacement of the compressor. When the discharge displacement of the compressor decreases, the flow rate of refrigerant in the refrigerant circuit decreases, which decreases the pressure difference ΔPd.

If the duty ratio to the coil 67 is increased to increase the upward electromagnetic force, the transmission rod 40 moves upward and the opening degree of the communication passage 47 is decreased. As a result, the compressor displacement is increased, and the pressure difference ΔPd is increased.

If the duty ratio to the coil 67 is decreased to decrease the upward electromagnetic force, the transmission rod 40 moves downward and the opening degree of the communication passage 47 is increased. As a result, the compressor displacement is decreased, and the pressure difference ΔPd is decreased.

As described above, the target value of the pressure difference ΔPd is determined by the duty ratio supplied to the coil 67. The control valve CV automatically determines the position of the transmission rod 40 according to changes of the pressure difference ΔPd to maintain the pressure difference ΔPd to the target value. The target value of the pressure difference ΔPd is changed by adjusting the duty ratio to the coil 67.

The embodiment of FIGS. 1 and 2 has the following advantages.

The movable end 54*a* of the bellows 54 contacts the transmission rod 40 and relatively moves in a direction that intersects the axis L of the valve housing 45. Therefore, the transmission rod 40 is prevented from being affected by the stress of the bellows 54, which tends to elastically incline because of tolerances in a direction that intersects the axis L. Also the increase of the friction between the transmission rod 40 and the valve housing 45 caused by the stress is avoided. Thus, the hysteresis in the operational characteristics of the control valve CV is reduced.

The movable end 54*a* of the bellows 54 is supported by the valve housing 45 through the support spring 69, which is fitted to the movable end 54*a*. Therefore, the inclination of the bellows 54 is corrected by the valve housing 45 through the support spring 69.

The support spring 69 is located outside the protrusion 68. Therefore, it is easy to apply a relatively large diameter coil spring for the support spring 69. Thus, the flexibility of design is improved.

The coil spring is used as the support spring 69. Since the coil spring has a center space, the space in the coil spring is used as the recess 69*a*.

It should be apparent to those skilled in the art that the present invention may be embodied in many other specific forms without departing from the spirit or scope of the invention. Particularly, it should be understood that the invention may be embodied in the following forms.

Figure 3:
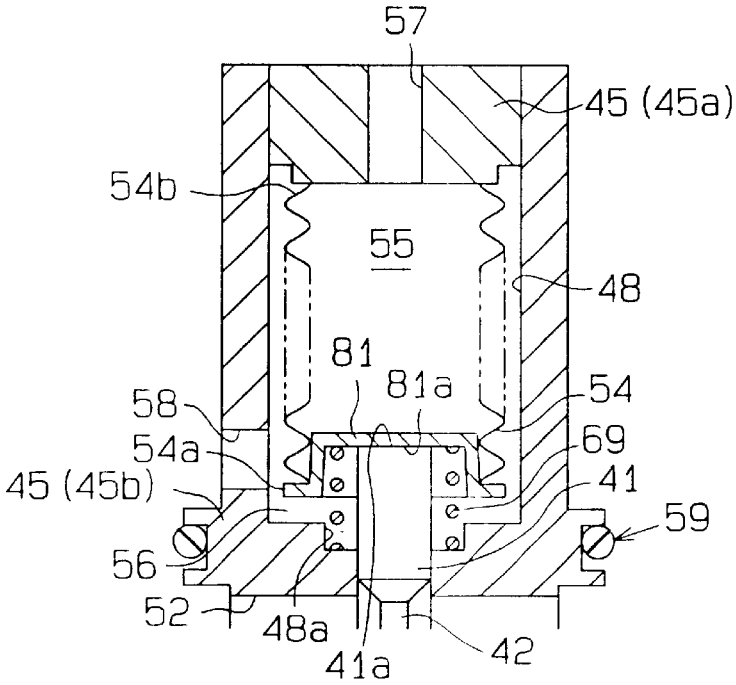
FIG. 3 is an enlarged partial cross-sectional view illustrating a control valve according to a second embodiment of the present invention.

FIG. 3 illustrates a second embodiment of the present invention. The second embodiment is a modification of the first embodiment. In the second embodiment, a recess 81 is formed on the movable end 54*a* of the bellows 54 and the distal end portion of the support spring 69 is fitted to the recess 81. In this case, the recess 81 is formed in the internal space of the bellows 54. Thus, the size of the control valve CV is minimized along the axis L. An inner end surface 81*a* of the recess 81 contacts an upper end surface 41*a* of the distal end portion 41.

Figure 4:
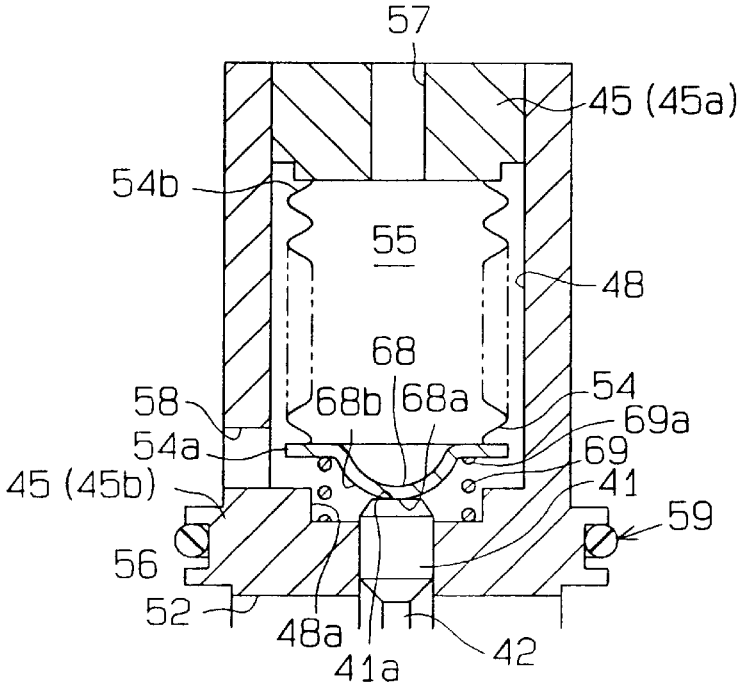
FIG. 4 is an enlarged partial cross-sectional view illustrating a control valve according to a third embodiment of the present invention.

FIG. 4 illustrates a third embodiment of the present invention. The third embodiment is a modification of the first embodiment. In the third embodiment, the lower end surface 68*a* of the protrusion 68 is semispherical. In this case, the force corresponding to the displacement of the bellows 54 is reliably applied to the transmission rod 40 along the axis L even when the bellows 54 is inclined. Therefore, the control valve CV operates in a suitable manner. The upper end surface 41*a* of the distal end portion 41 may be semispherical.

Figure 5:
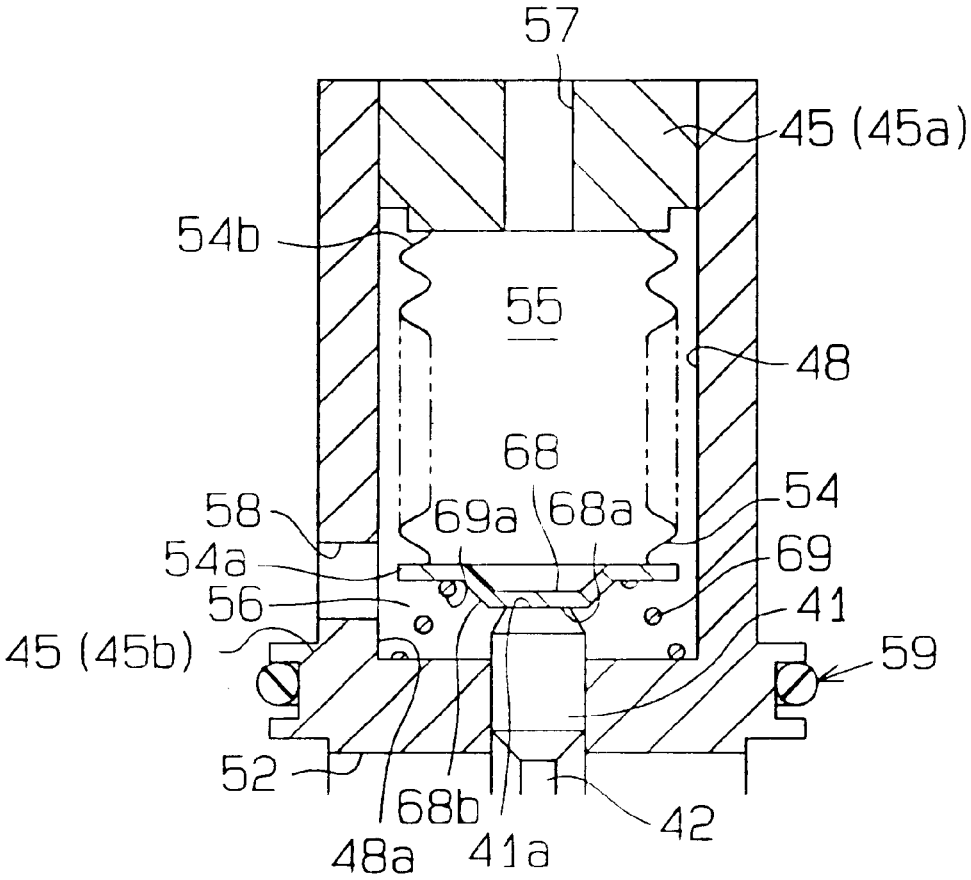
FIG. 5 is an enlarged partial cross-sectional view illustrating a control valve according to a fourth embodiment of the present invention.

FIG. 5 illustrates a fourth embodiment of the present invention. The fourth embodiment is a modification of the first embodiment. In the fourth embodiment, the support spring 69 is a conic coil spring. Since the conic coil spring is tough against the bending load, the inclination of the bellows 54 is more reliably corrected.

A disk spring may be used as the support spring 69.

A rubber may be used as the elastic member.

Figure 6:
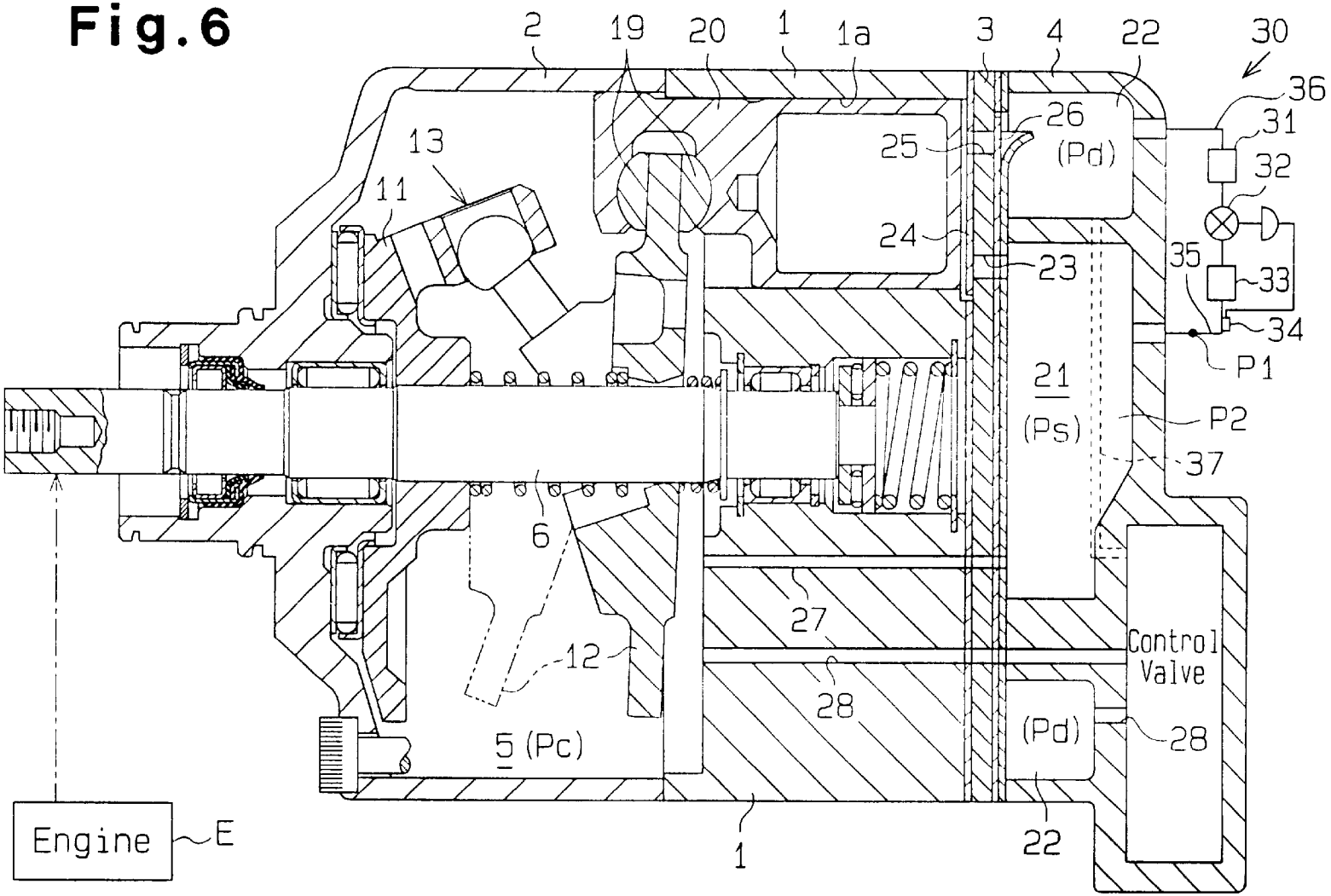
FIG. 6 is an enlarged partial cross-sectional view illustrating a control valve according to a fifth embodiment of the present invention.

FIG. 6 illustrates a fifth embodiment of the present invention. The fifth embodiment is a modification of the first embodiment. In the fifth embodiment, the first pressure monitoring point P1 is located in the suction pressure zone, which includes the evaporator 33 and the suction chamber 21. Specifically, the first pressure monitoring point P1 is located in the downstream pipe 35. The second pressure monitoring point P2 is also located in the suction pressure zone and downstream of the first pressure monitoring point P1. Specifically, the second pressure monitoring point P2 is located in the suction chamber 21.

The first pressure monitoring point P1 may be located in the discharge pressure zone, which includes the discharge chamber 22 and the condenser 31, and the second pressure monitoring point P2 may be located in the suction pressure zone, which includes the evaporator 33 and the suction chamber 21.

The communication passage 47 may be connected to the discharge chamber 22 through the second valve port 52 of the control valve CV and the upstream part of the supply passage 28, and the valve chamber 46 may be connected to the crank chamber 5 through the first valve port 51 of the control valve CV and the downstream part of the supply passage 28.

The solenoid 60, which is externally controlled, may be eliminated from the control valve CV and the control valve CV may be an internal control valve.

The pressure sensing member of the control valve CV may be operated in accordance with one of the suction pressure Ps, the crank chamber pressure Pc, or the discharge pressure Pd. For example, only one pressure monitoring point P1 may be provided in the embodiments illustrated in FIGS. 1 to 6 and the second pressure chamber 56 may be exposed to the atmosphere (constant pressure) or may be vacuumed.

The control valve CV may be used as a bleed control valve for controlling the crank chamber pressure Pc by controlling the opening of the bleed passage 27 instead of the supply passage 28.

The present invention may be embodied in a control valve of a wobble type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor installed in a refrigerant circuit, wherein the compressor varies the displacement in accordance with the pressure in a crank chamber, wherein the compressor has a control passage, which connects the crank chamber to a pressure zone in which the pressure is different from the pressure of the crank chamber, the control valve comprising:

a valve housing;

a valve chamber defined in the valve housing;

a valve body, which is accommodated in the valve chamber for adjusting the opening degree of the control passage;

a pressure sensing chamber defined in the valve housing, wherein the pressure at a pressure monitoring point in the refrigerant circuit is applied to the pressure sensing chamber;

a bellows, which is located in the pressure sensing chamber, wherein the bellows has a movable end;

a transmission rod slidably supported by the valve housing between the valve chamber and the pressure sensing chamber, wherein the transmission rod moves the valve body in accordance with the displacement of the bellows, wherein the bellows is displaced in accordance with the variations of the pressure in the pressure sensing chamber thereby moving the valve body such that the displacement of the compressor is adjusted to cancel the variations of the pressure in the pressure sensing chamber, and wherein the movable end of the bellows and the transmission rod contact each other and can be relatively displaced in a direction intersecting the axis of the valve housing; and an elastic member located between the inner wall of the pressure sensing chamber and the movable end of the bellows, wherein the elastic member elastically supports the movable end such that the movable end can be displaced, and wherein one of the elastic member and the movable end of the bellows includes a recess and the other one includes a protrusion such that the elastic member and the movable end of the bellows are fitted to each other.

2. The control valve according to claim 1, wherein the recess is arranged on the elastic member, and the protrusion is arranged on the movable end of the bellows.

3. The control valve according to claim 1, wherein the protrusion is arranged on the elastic member, and the recess is arranged on the movable end of the bellows.

4. The control valve according to claim 1, wherein the elastic member is a coil spring.

5. The control valve according to claim 4, wherein the coil spring is conic.

6. The control valve according to claim 1, wherein the protrusion is semispherical.

7. The control valve according to claim 1, wherein the bellows define a first pressure chamber and a second pressure chamber in the pressure sensing chamber, and wherein the pressure at a first pressure monitoring point in the refrigerant circuit is applied to the first pressure chamber, and the pressure at a second pressure monitoring point, which is downstream of the first pressure monitoring point, is applied to the second pressure chamber.

8. The control valve according to claim 7, wherein the bellows is displaced in accordance with the variations of the pressure difference between the first pressure chamber and the second pressure chamber.

9. The control valve according to claim 7, wherein the refrigerant circuit has a discharge pressure zone, and wherein the first and the second pressure monitoring points are located in the discharge pressure zone.

10. The control valve according to claim 7, wherein the refrigerant circuit has a suction pressure zone, and wherein the first and the second pressure monitoring points are located in the suction pressure zone.

11. The control valve according to claim 7 further comprising an actuator for applying force to the bellows in accordance with an externally supplied electric current, wherein the force applied by the actuator reflects the target value of the pressure difference between the first pressure chamber and the second pressure chamber, and wherein the bellows moves the valve body such that the pressure difference seeks to the target value.

12. A control valve used for a variable displacement compressor installed in a refrigerant circuit, wherein the compressor varies the displacement in accordance with the pressure in a crank chamber, wherein the compressor has a control passage, which connects the crank chamber to a pressure zone in which the pressure is different from the pressure of the crank chamber, the control valve comprising:

a valve housing;

a valve chamber defined in the valve housing;

a valve body, which is accommodated in the valve chamber for adjusting the opening degree of the control passage;

a pressure sensing chamber defined in the valve housing, wherein the pressure at a pressure monitoring point in the refrigerant circuit is applied to the pressure sensing chamber;

a bellows, which is located in the pressure sensing chamber, wherein the bellows has a movable end;

a transmission rod slidably supported by the valve housing between the valve chamber and the pressure sensing chamber, wherein the transmission rod includes the valve body, and the bellows is displaced in accordance with the variations of the pressure in the pressure sensing chamber thereby moving the valve body such that the displacement of the compressor is adjusted to cancel the variations of the pressure in the pressure sensing chamber, and wherein the movable end of the bellows and the transmission rod contact each other and can be relatively displaced in a direction intersecting the axis of the valve housing; and an elastic member located between the inner wall of the pressure sensing chamber and the movable end of the bellows, wherein the elastic member directly contacts the inner wall of the pressure sensing chamber and the movable end of the bellows wherein the elastic member elastically supports the movable end such that the movable end can be displaced, and wherein the movable end of the bellows includes a protrusion and the elastic member includes a recess such that the elastic member and the movable end of the bellows are fitted to each other.

13. The control valve according to claim 12, wherein the elastic member is a coil spring.

14. The control valve according to claim 13, wherein the coil spring is conic.

15. The control valve according to claim 12, wherein the protrusion is semispherical.

16. The control valve according to claim 12, wherein the bellows define a first pressure chamber and a second pressure chamber in the pressure sensing chamber, and wherein the pressure at a first pressure monitoring point in the refrigerant circuit is applied to the first pressure chamber, and the pressure at a second pressure monitoring point, which is downstream of the first pressure monitoring point, is applied to the second pressure chamber.

17. The control valve according to claim 16, wherein the bellows is displaced in accordance with the variations of the pressure difference between the first pressure chamber and the second pressure chamber.

18. The control valve according to claim 16, wherein the refrigerant circuit has a discharge pressure zone, and wherein the first and the second pressure monitoring points are located in the discharge pressure zone.

19. The control valve according to claim 16, wherein the refrigerant circuit has a suction pressure zone, and wherein the first and the second pressure monitoring points are located in the suction pressure zone.

20. The control valve according to claim 16 further comprising an actuator for applying force to the bellows in accordance with an externally supplied electric current, wherein the force applied by the actuator reflects the target value of the pressure difference between the first pressure chamber and the second pressure chamber, and wherein the bellows moves the valve body such that the pressure difference seeks to the target value.

21. A control valve used for a variable displacement compressor installed in a refrigerant circuit, wherein the compressor varies the displacement in accordance with the pressure in a crank chamber, wherein the compressor has a control passage, which connects the crank chamber to a pressure zone in which the pressure is different from the pressure of the crank chamber, the control valve comprising:

a valve housing;

a valve chamber defined in the valve housing;

a valve body, which is accommodated in the valve chamber for adjusting the opening degree of the control passage;

a pressure sensing chamber defined in the valve housing, wherein the pressure at a pressure monitoring point in the refrigerant circuit is applied to the pressure sensing chamber;

a bellows, which is located in the pressure sensing chamber, wherein the bellows has a movable end, wherein the bellows define a first pressure chamber and a second pressure chamber in the pressure sensing chamber, and wherein the pressure at a first pressure monitoring point in the refrigerant circuit is applied to the first pressure chamber, and the pressure at a second pressure monitoring point, which is downstream of the first pressure monitoring point, is applied to the second pressure chamber;

a transmission rod slidably supported by the valve housing between the valve chamber and the pressure sensing chamber, wherein the transmission rod moves the valve body in accordance with the displacement of the bellows, wherein the bellows is displaced in accordance with the variations of the pressure in the pressure sensing chamber thereby moving the valve body such that the displacement of the compressor is adjusted to cancel the variations of the pressure in the pressure sensing chamber, and wherein the movable end of the bellows and the transmission rod contact each other and can be relatively displaced in a direction intersecting the axis of the valve housing; and an elastic member located between the inner wall of the pressure sensing chamber and the movable end of the bellows, wherein the elastic member elastically supports the movable end such that the movable end can be displaced, and wherein one of the elastic member and the movable end of the bellows includes a recess and the other one includes a protrusion such that the elastic member and the movable end of the bellows are fitted to each other.

* * * * *